US007818920B2

(12) United States Patent
Causey et al.

(10) Patent No.: US 7,818,920 B2
(45) Date of Patent: Oct. 26, 2010

(54) BARRIER GATE WITH TORQUE LIMITER

(76) Inventors: Lynn R. Causey, 4347 Waterloo Rd., Russellville, AL (US) 35653; Roger D. Causey, 501 Whippoorwill Cir., Russellville, AL (US) 35654

( * ) Notice: Subject to any disclaimer, the term of this patent is extended or adjusted under 35 U.S.C. 154(b) by 22 days.

(21) Appl. No.: 11/982,927

(22) Filed: Nov. 6, 2007

(65) Prior Publication Data

US 2009/0116903 A1 May 7, 2009

(51) Int. Cl.
*E01F 13/00* (2006.01)

(52) U.S. Cl. ..... 49/49

(58) Field of Classification Search ..... 49/49, 49/26; 404/9, 10; 246/127
See application file for complete search history.

(56) References Cited

U.S. PATENT DOCUMENTS

| | | | | |
|---|---|---|---|---|
| 438,620 | A * | 10/1890 | Gillette | 318/264 |
| 1,654,606 | A | 1/1928 | Sawyer | |
| 1,952,641 | A * | 3/1934 | Vincent | 49/26 |
| 2,228,909 | A * | 1/1941 | Glowka | 246/294 |
| 3,069,118 | A | 12/1962 | Bernard | |
| 4,101,235 | A | 7/1978 | Nelson | |
| 4,227,344 | A | 10/1980 | Poppke | |
| 4,232,484 | A * | 11/1980 | Buchmann | 49/334 |
| 5,823,705 | A | 10/1998 | Jackson et al. | |
| 6,179,517 | B1 * | 1/2001 | Nelson | 404/6 |
| 6,312,188 | B1 | 11/2001 | Ousterhout et al. | |
| 6,487,818 | B1 * | 12/2002 | Hamann et al. | 49/49 |
| 6,796,084 | B2 * | 9/2004 | Gagnon | 49/226 |
| 6,896,443 | B1 | 5/2005 | Ousterhout et al. | |
| 7,062,879 | B2 * | 6/2006 | Wenzl et al. | 49/49 |
| 7,065,923 | B2 * | 6/2006 | Parsadayan et al. | 49/141 |
| 7,125,197 | B2 | 10/2006 | Krewson et al. | |
| 7,195,419 | B2 | 3/2007 | Gelfand | |
| 7,210,873 | B2 | 5/2007 | Gelfand | |
| 7,263,803 | B2 * | 9/2007 | Herwich et al. | 49/49 |
| 7,367,746 | B2 * | 5/2008 | Hosokawa | 404/11 |
| 2002/0109131 | A1 | 8/2002 | Smith et al. | |
| 2003/0029090 | A1 * | 2/2003 | Gillingham | 49/49 |
| 2004/0182005 | A1 * | 9/2004 | Basio | 49/49 |

FOREIGN PATENT DOCUMENTS

| | | |
|---|---|---|
| WO | WO/2006083429 | 8/2006 |

* cited by examiner

*Primary Examiner*—Katherine W Mitchell
*Assistant Examiner*—Catherine A Kelly
(74) *Attorney, Agent, or Firm*—Schultz & Associates, P.C.

(57) ABSTRACT

Disclosed is an apparatus for a barrier gate designed to control vehicular travel through a passageway. The invention disclosed employs a barrier arm, a housing, a motor and transmission, a rotary encoder, and a torque limiter assembly. The torque limiter assembly comprises a hub, spindle, brake disk, rotor, and a gland nut. The torque limiter assembly is mounted to the motor and transmission as well as connected to the barrier arm. The torque limiter assembly provides sufficient friction to rotate the barrier arm and also protects the internal gears and linkages of the transmission and motor from costly repair/replacement by preventing any unwanted rotation. In the event an outside force rotates the barrier arm, the rotary encoder in cooperation with a controller instantly recognizes the position of the barrier arm and further acts as a limit switch to send a signal to the motor to stop when the barrier arm is in place.

15 Claims, 8 Drawing Sheets

BARRIER GATE WITH TORQUE LIMITER

FIELD OF THE INVENTION

This invention relates to barrier gates for roadways. In particular, this invention relates to an apparatus and method for preventing damage to the internal gears that move the barrier gate through the use of a torque limiter connected between the control arm of the gate and the transmission of the motor.

BACKGROUND OF THE INVENTION

Barrier gates that incorporate the use of a pivoting barrier arm are in widespread use. Typical uses of such devices include high occupancy freeway lane entrances, controlled parking lot entries and exits, toll booth lanes, airport entries and exits, railroad crossings, and drawbridges. Most often designs include some sort of actuator to initiate movement of the barrier arm such as a remote control, weight sensitive sensor, or an electronic card reader. Once a signal is received, a motor drives the internal mechanisms to rotate the barrier arm into the open or closed position. The motor and the transmission that convert the rotational motion into the proper orientation and speed are intricate components of the barrier gate system and are costly to repair or replace. Additionally the down time associated with the repair of a damaged motor or transmission prevents the use of the particular lane or passageway causing added expense and possibly traffic congestion. A motor or transmission can be easily damaged if a force from an unexpected direction occurs, moving the barrier. Such a force generally causes the internal gears and linkages of the motor and transmission to be damaged.

Prior art barrier gates have addressed this need in various ways. One way is to design the barrier arm itself to be of a breakaway nature. If an unexpected force is applied to the barrier arm, the barrier arm itself is designed to fail before the components are damaged. While this solution does indeed protect the internal components, the barrier arm itself requires replacement often and the barrier gate ceases to function as a traffic controlling passageway while the barrier arm is missing.

Other prior art barrier gates have designed the internal gears and mechanisms to withstand great pressure before failing by reinforcing them with high strength materials. Typical weather forces or the unwanted manual manipulation of the barrier arm will not be sufficient to move the barrier arm. A design such as this is costly and not marketable but in only the most heavy duty of applications.

Other traffic control devices known in the art such as U.S. Pat. No. 4,101,235 to Nelson employ an elongate series of tire engaging spikes extending transverse to an entering or exit lane of a parking lot or other controlled area. The spikes are carried by a shaft rotatably supported below the surface of the lane. The device discloses a drive means including a reversible electric motor to rotate the shaft between a normal and an actuated position. The device further includes an actuating switch means to cause the motor to rotate the shaft between a normal and an actuated position. Since there is not barrier arm available to lift, the gears of the motor are not in jeopardy from outside forces, but this type of warning lane system can cause expensive damage to the user's vehicle and subject the operator of the system to disgruntled users and possible litigation.

U.S. Pat. No. 4,227,344 to Poppke discloses an automatic parking lot gate with four-way flex connector. The flexible connector includes a first connection plate connected to the arm drive mechanism, a second connection plate connected to the gate arm, and first and second coil springs connected between the first and second connection plates. The coil springs are positioned essentially parallel to one another in a vertical plane. When exposed to outside forces such as a car, the barrier gate will continually flex back towards the starting point and continually apply pressure to the vehicle attempting to gain access. The resilient pressure of the barrier arm can cause damage to the vehicle in the form of dents and abrasions in the paint.

SUMMARY OF INVENTION

An apparatus for controlling vehicular travel through roadway passageways including a rotationally movable barrier arm is disclosed. The present invention addresses the need to safeguard the internal linkages and gears of the motor and transmission of the barrier gate from unwanted rotation due to outside forces and thus avoiding costly repairs and downtime. The barrier gate disclosed includes a barrier arm pivotally attached to a housing. The housing is anchored to the ground and includes a motor, a transmission, a torque limiter assembly, and a rotary encoder. The motor and transmission are pivotally connected to a horizontal axis torque limiter assembly. The torque limiter assembly is connected to an auxiliary crank which is ultimately connected to the shaft that provides the rotational axis for the barrier arm. The auxiliary crank is also connected to the rotary encoder to locate the angular position of the barrier arm at any time a controller is supplied, connected to the rotary encoder to provide input signals to the motor dependent on the position of the rotary encoder. One embodiment also provides a solid vertical axis torque limiter assembly allowing movement of the barrier gate in a horizontal plane.

The horizontal axis torque limiter assembly comprises a hub, a spindle, a brake caliper, and a brake disk. The brake caliper includes adjustable pressure bolts which create friction on the brake disk. The brake disk is rigidly connected to the hub which is further connected to the auxiliary crank. The motor and transmission rotate the torque limiter assembly and the friction created by the torque limiter assembly rotates the auxiliary crank and thus the barrier arm. The friction created by the torque limiter assembly is sufficient to move the barrier arm when a signal is received from the controller. But, in the event that an outside force acts on the barrier arm such as high winds or a vehicle driving under the barrier arm, the torque limiter assembly allows movement of the barrier arm in a vertical plane, but will not allow rotation of the spindle, thereby protecting the motor and transmission drive. In other words, the friction created by the torque limiter assembly is sufficiently balanced to move the barrier when the motor and transmission drive are activated, but not sufficient to damage the gears of the transmission. Further, a program is provided in the controller to reposition the barrier arm after movement.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
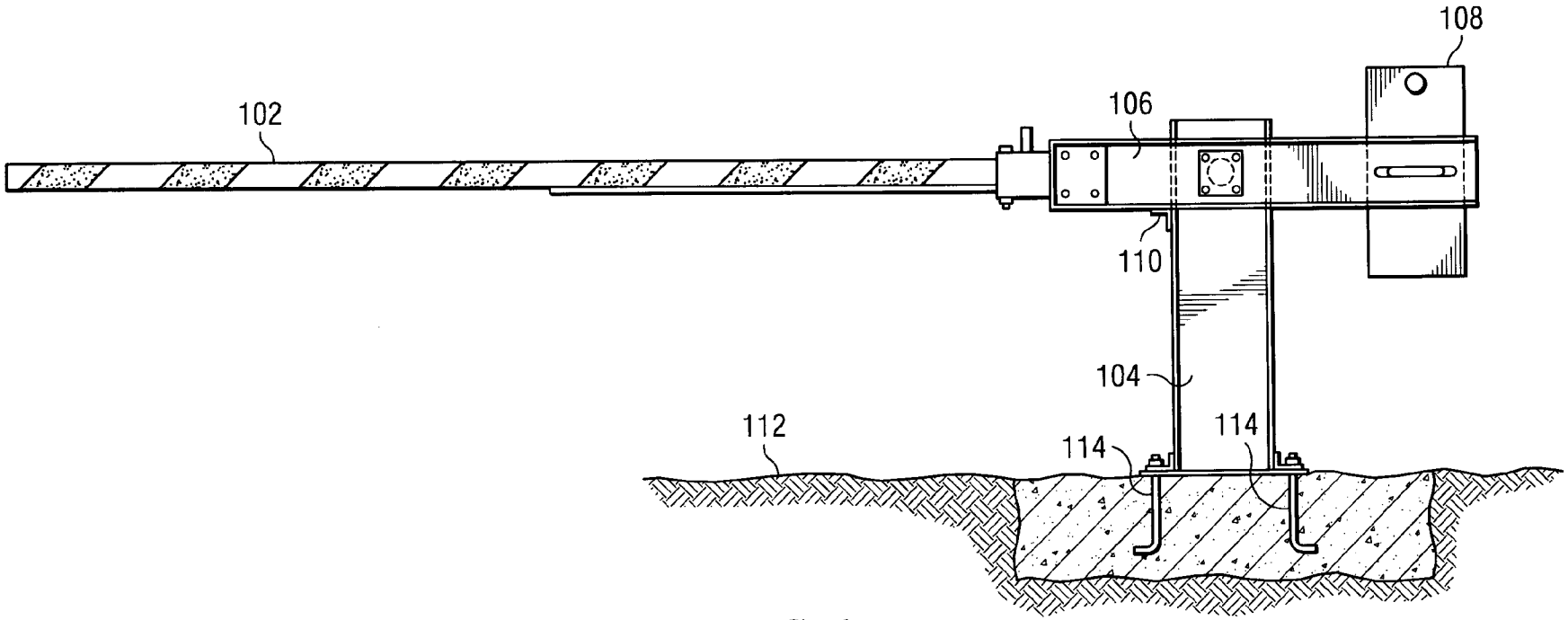
FIG. 1 is an elevation view of a preferred embodiment of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

The present invention is a barrier gate for roadways that includes a rotating arm and a torque limiter. In the event the arm of the gate is moved out of position, the torque limiter prevents costly damage to the internal gears and linkages of the transmission and motor. The present invention can be installed at various vehicle passageways such as railroad crossings, high-occupancy lane entrances, draw bridges, parking lot entries and exits, etc. The specific dimensions of the present invention can be adjusted to accommodate smaller or larger applications as needed.

FIG. 1 shows a preferred embodiment of the present invention. Barrier arm 102 is connected to arm frame 106 by a plurality of bolts. Arm frame 106 is pivotally connected to housing 104 at two points on opposite sides of housing 104. In an alternate embodiment, arm frame 106 is pivotally attached to housing 104 at one point on one side of housing 104. Counterweight 108 is affixed to arm frame 106 to counter balance the moment arm produced by the weight of barrier arm 102. Arm stop 110 prevents arm frame 106 from rotating past parallel to surface 112. Housing 104 is secured to surface 112 via a plurality of anchors 114. Depending on the application of the present invention, surface 112 may be any horizontal surface, such as a bridge truss or a roadbed.

Figure 2:
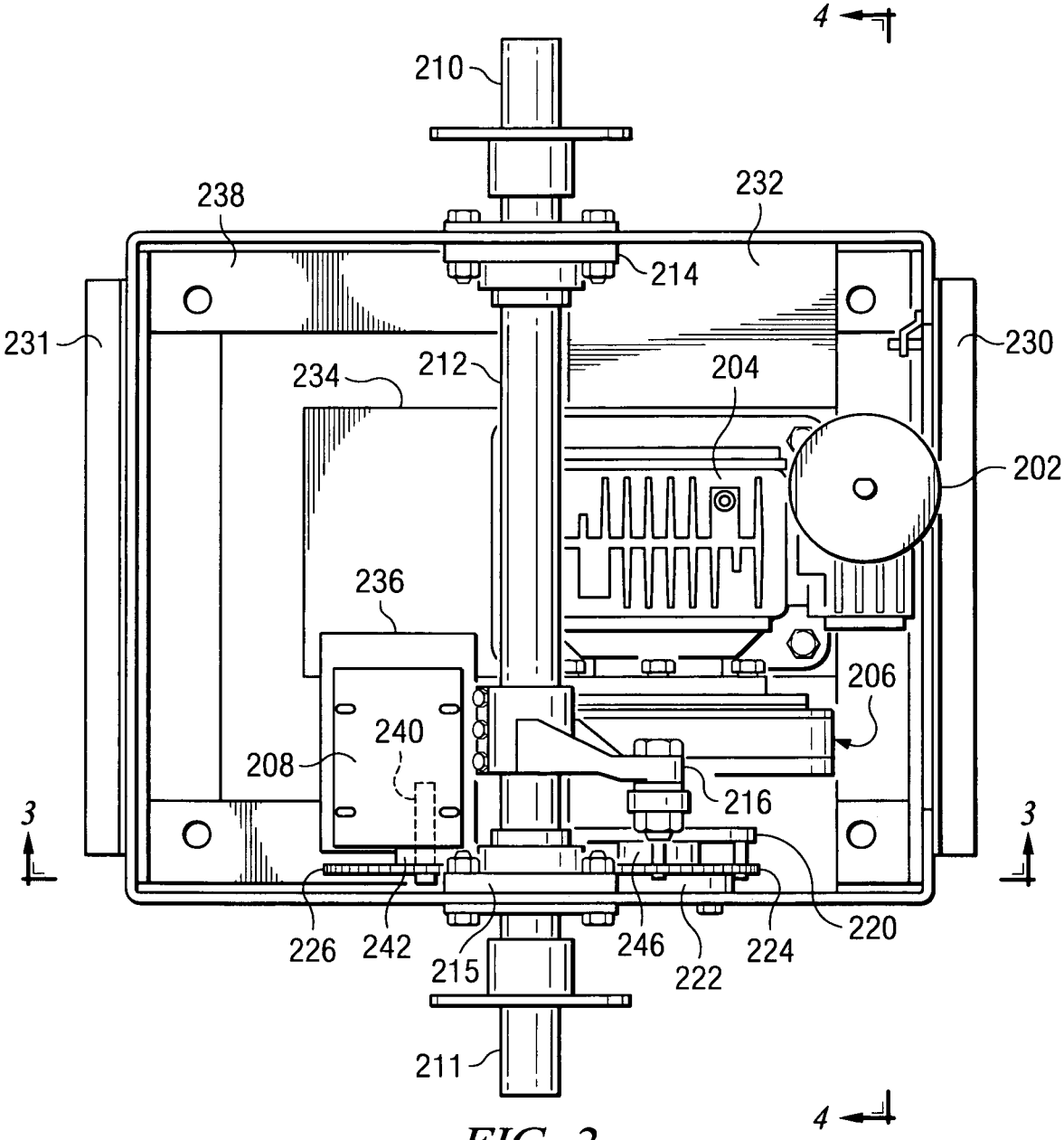
FIG. 2 is a plan view of the housing with the barrier arm and the top cover removed of a preferred embodiment of the present invention.
Figure 3:
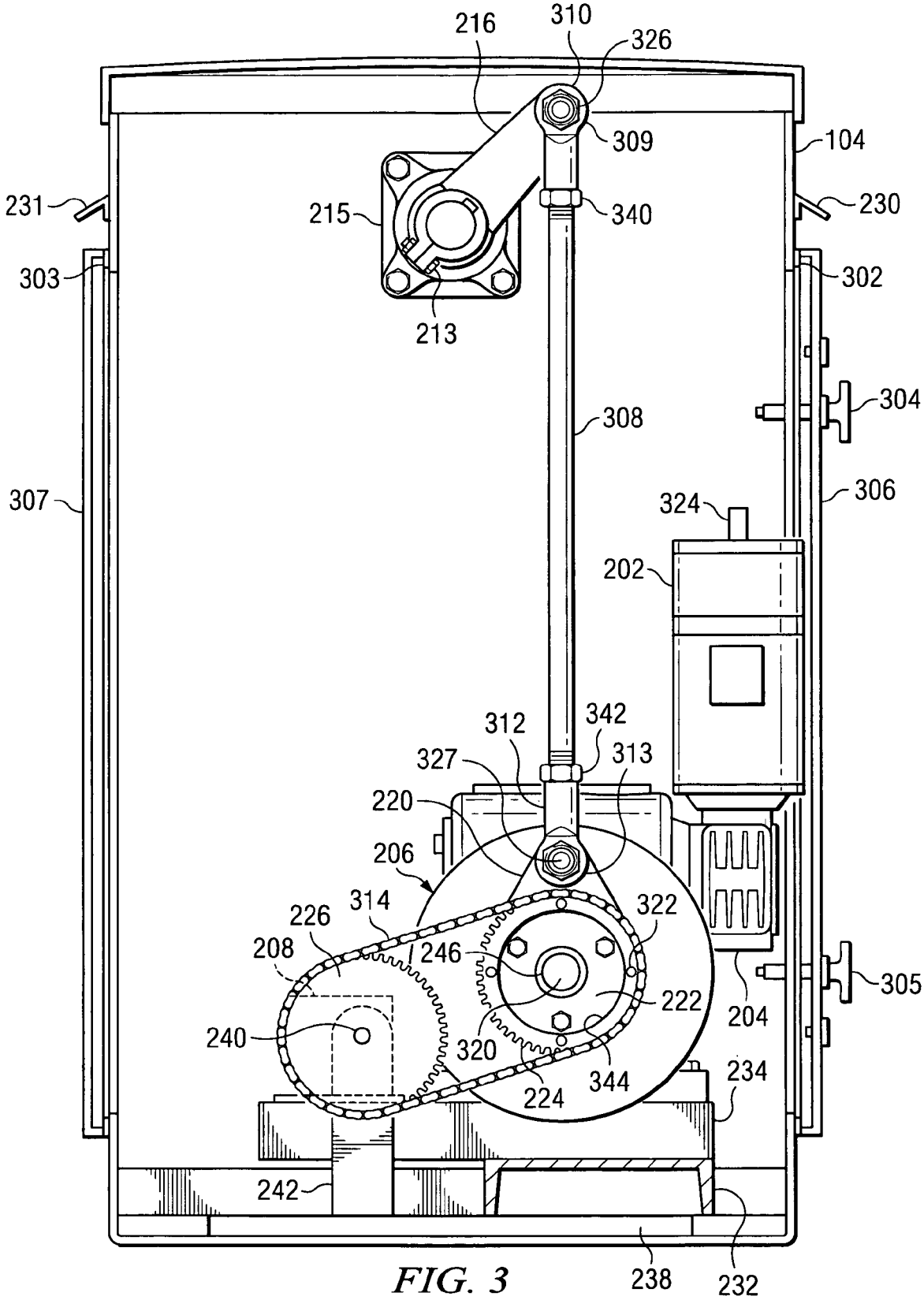
FIG. 3 is an elevation view of the housing along line 3-3 of FIG. 2 of a preferred embodiment of the present invention.
Figure 4:
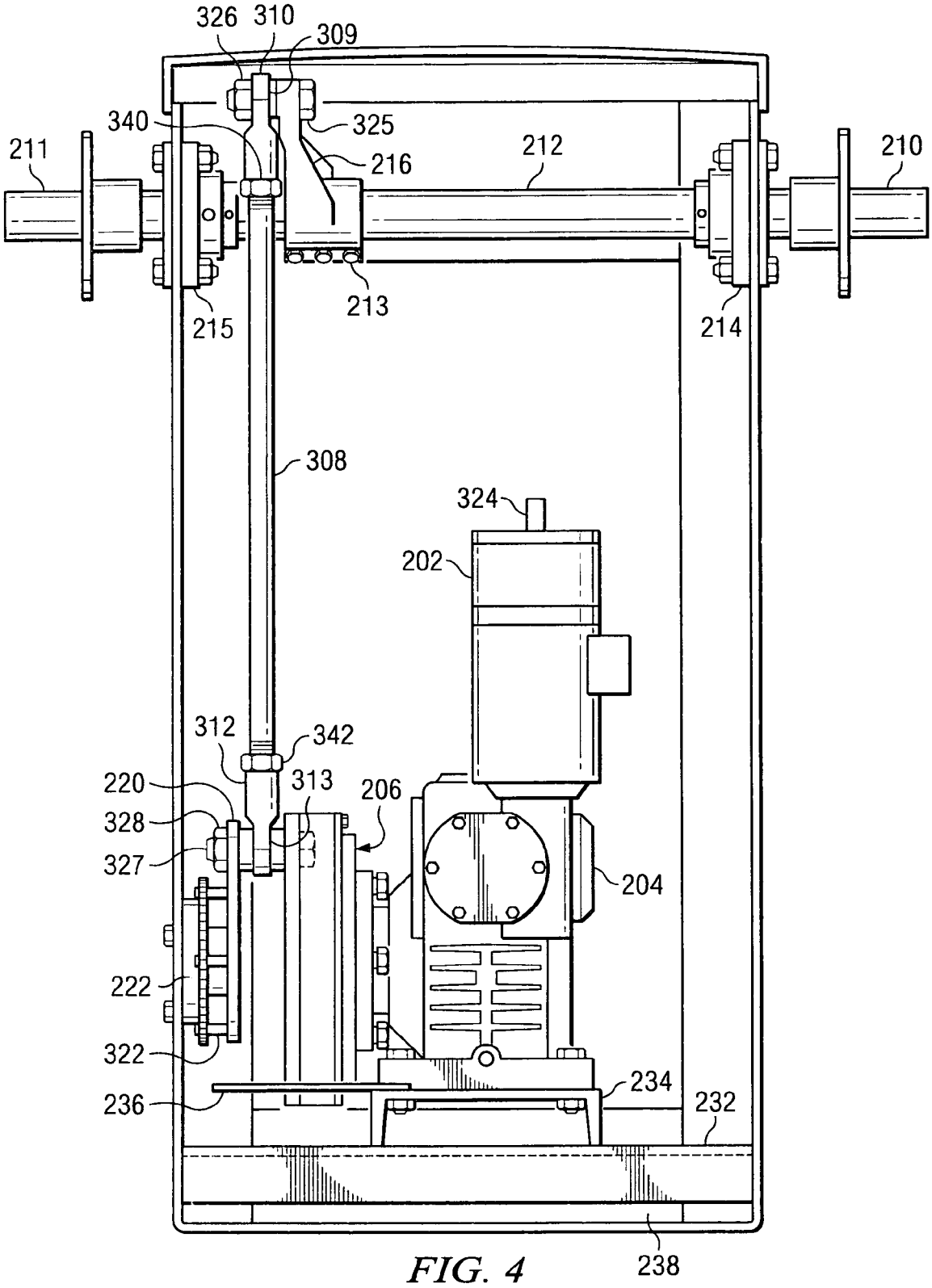
FIG. 4 is an elevation view of the housing along line 4-4 of FIG. 2 of a preferred embodiment of the present invention.

FIGS. 2, 3, and 4 show the internal components of a preferred embodiment without the attached arm frame 106 and barrier arm 102. Housing 104 is a generally hollow rectangular structure constructed of ¼ inch carbon steel side walls and top cover. The preferred embodiment includes housing 104. Housing 104 is weatherproof and corrosion resistant.

Bearings 214 and 215 are attached to opposite sides of housing 104 by a plurality of bolts and provide rotatable support for shaft 212. In the preferred embodiment, shaft 212 is constructed of AISI 4150 steel and can range in diameter depending on the application between 1½ to 3 inches. Attachment hubs 210 and 211 are positioned on opposite ends of shaft 212 as shaft 212 extends beyond the exterior walls of housing 104 and provide mounting points for arm frame 106. Crank 216 is affixed to shaft 212 with through belts 213. Rod end 310 is affixed to connecting rod 308 by jam nut 340. Rod end 310 is connected to crank 216 through eyelet 309 with bolt 325 and nut 326. Rod end 312 is connected to connecting rod 308 by jam nut 342. Rod end 312 is connected to auxiliary crank 220 and torque limiter assembly 206 through eyelet 313 by bolt 327 and nut 328. Auxiliary crank 220 is an eccentric disk member that includes a protruding flange for attachment to connecting rod 308. Crank 216, connecting rod 308, and auxiliary crank 220 form a mechanical 4-bar linkage defining a 360 degrees travel of auxiliary crank 220 and a 90 degrees travel of crank 216.

Transmission sprocket 224 is a flat ring shaped 68 tooth sprocket. Transmission sprocket 224 defines a concentrically aligned sprocket hole 344. Transmission sprocket 224 is concentrically aligned with and mounted to the circular section of auxiliary crank 220 by set of four bolts through a set of four sprocket spacers 322 spaced equidistant proximate the perimeter of transmission sprocket 224. Auxiliary crank shaft 320 is integrally formed with or rigidly affixed to auxiliary crank 220 at the center point of auxiliary crank 220. Auxiliary crank shaft 320 is rotatably supported by bearing 222 and provides a rotational axis for auxiliary crank 220. Bearing 222 is attached to the interior surface of housing 104 by a plurality of bolts and includes a permanently lubricated bearing hub 246 which supports auxiliary crank shaft 320.

Roller chain 314 is a series of connected links formed from high strength steel and constructed as is common in the art. In the preferred embodiment, the roller chain is ANSI 80 single pitch roller chain capable of transmitting about three horsepower. In an alternate embodiment, roller chain 314 is a notched timing belt and sprockets 224 and 226 are notched gears. Roller chain 314 is engaged with transmission sprocket 224 and sprocket 226. Roller chain 314 transmits the rotational motion of transmission sprocket 224 to sprocket 226. Sprocket 226 is the same diameter and contains the same number of teeth as transmission sprocket 224 thereby ensuring a 1:1 ratio as transmission sprocket 224 is rotated by motor 202. Sprocket 226 rotates around shaft 240 located at the center of sprocket 226. Shaft 240 is supported by brace 242 and rotary encoder 208. Rotary encoder 208 is an electromechanical device common in the art used to convert the position of shaft 240 to an analog or digital code. Encoders such as BEI Industrial Encoders model H25 or H25X or Gurley Precision Instruments model 7700 are used in the preferred embodiment. Rotary encoder 208 determines and tracks the position of auxiliary crank shaft 320 and thus barrier arm 102 at all times.

Motor 202 is directly mounted to transmission 204. Motor 202 is an electric motor where the voltage, phase and horsepower are determined by each specific application. Horsepower can range from ½ horsepower to up to 7½ horsepower for heavy duty applications. In the preferred embodiment, the motor is provided by Baldor Electric Company or Leeson Electric Motors and the transmission is provided by Peerless-Winsmith, Incorporated. Motor 202 includes manual crank 324. Manual crank 324 facilitates manual operation of the barrier arm in case motor 202 malfunctions. Transmission 204 includes a drive shaft (not shown) that extends from transmission 204 and into drive shaft hole 530 of torque limiter assembly 206. The drive shaft has a keyed cross-section that fits securely into drive shaft hole 530 and is locked in place with a cotter key (also not shown). Transmission 204 reduces the speed of motor 202 to the drive shaft and ultimately to torque limiter assembly 206 at a ratio of approximately 1000:1. Transmission 204 is mounted on platform 234 by a plurality of bolts. Platform 234 is a rectangular shaped support member approximately ¼ inch thick with a "C-shaped" cross section. In the preferred embodiment, platform 234 is constructed of high strength steel or cast iron and is capable of supporting the combined weight of motor 202 and transmission 204 or approximately 250 pounds. Platform 234 rests approximately at the midpoint of and perpendicular to base 232. In the preferred embodiment, base 232 is constructed of high strength steel or cast iron approximately ¼ inch thick and rests adjacent to foundation 238. Base 232 spans the width of housing 104. Foundation 238 comprises four ¼ inch plate steel planks approximately four inches wide. The four planks of foundation 238 are attached to the bottom of the interior of housing 104 by a plurality of bolts or by spot welding. Support 236 is a ⅛ inch plate steel rectangle connected to platform 234 and brace 242. Support 236 provides a level mounting surface for rotary encoder 208.

As shown in FIGS. 2 and 3, the exterior of housing 104 includes doors 306 and 307. Above door 306 is drip guard 230. Above door 307 is drip guard 231. Drip guards 230 and 231 are integrally formed angular protrusions constructed of ¼ inch carbon steel that run approximately the width of housing 104. Doors 306 and 307 include gaskets 302 and 303 respectively. Gaskets 302 and 303 are neoprene bulb-type gaskets which seal the door openings. Latches 304 and 305 provide handles to open door 306 and also keep door 306 firmly closed. In the preferred embodiment, door 306 incorporates latches or handles and door 307 utilizes a plurality of screws to remain closed. In alternate embodiments, either door can utilize either fastening mechanisms to remain closed. In an additional alternate embodiment, a locakable strap can be used with heavy duty padlocks.

Figure 5:
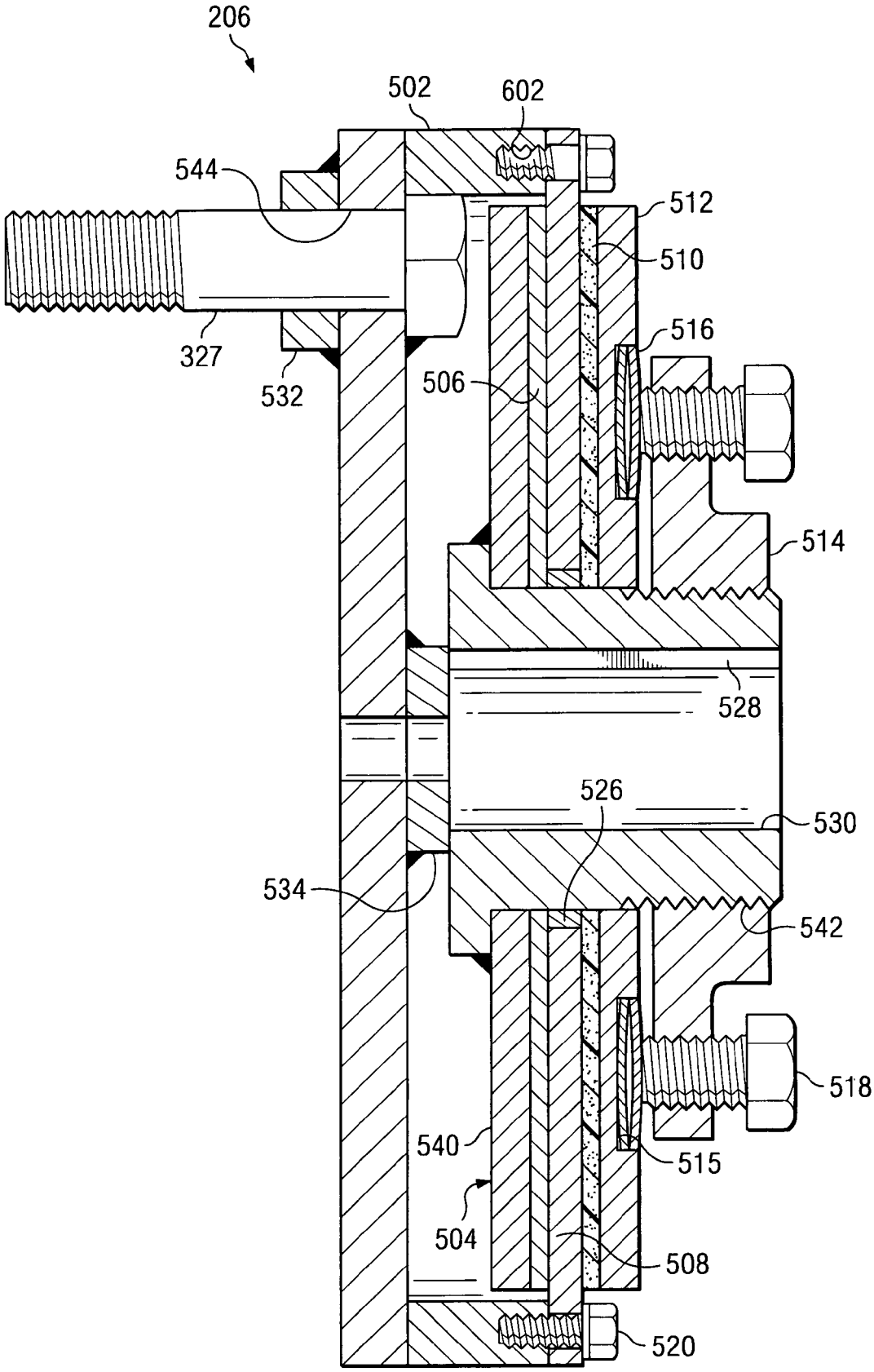
FIG. 5 is a sectional view of a preferred embodiment of a torque limiter assembly of the present invention.
Figure 6:
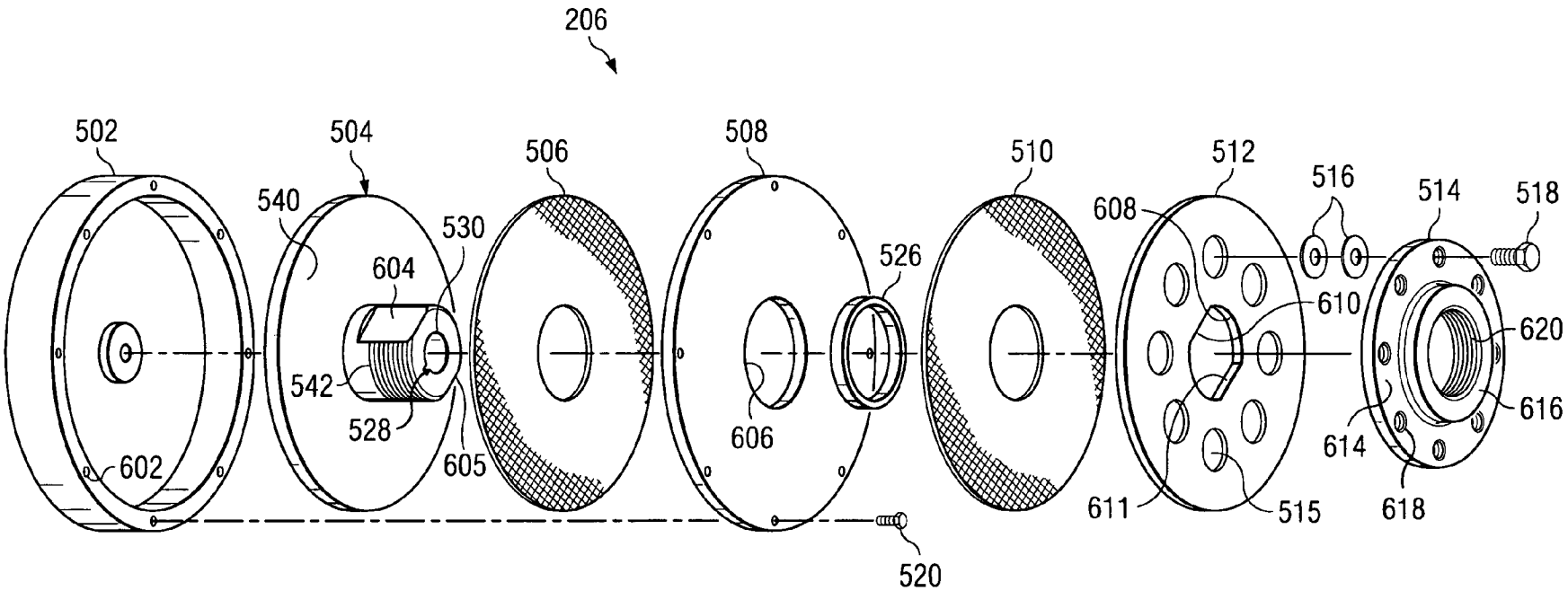
FIG. 6 is an exploded isometric view of the components of a preferred embodiment of the torque limiter assembly of the present invention.

The components of torque limiter assembly 206 can be seen in FIGS. 5 and 6. Torque limiter assembly 206 includes hub 502, spindle 504, brake linings 506 and 510, brake disk 508, rotor plate 512, and gland nut 514.

The components of torque limiter assembly 206 are generally circular in shape and are concentrically aligned. Hub 502 is a circular dish shape constructed of ½ inch steel plate. Hub 502 includes mounting hole 544, a plurality of brake disk mounting holes 602, reinforcement 532, and spacer 534. Mounting hole 544 is located proximate the perimeter of hub 502 and is approximately ¾ to 1 inch in diameter. In the preferred embodiment, eight (8) brake disk mounting holes 602 are equally spaced in the perimeter wall of hub 502. The axis of each brake disk mounting hole 602 is parallel to the center axis of hub 502. Reinforcement 532 surrounds mounting hole 544 on the exterior of hub 502. Reinforcement 532 can be integrally formed with hub 502 or can be a distinct part separate from hub 502 welded to hub 502 that fits into mounting hole 544 and extends from hub 502. Spacer 534 is a flat circular shaped extension protruding approximately ½ inch from the interior of hub 502. Spacer 534 has an approximate diameter of 2 inches and provides room for spindle 504 to rotate without interfering with the head of bolt 327 while further providing support for spindle 504.

Spindle 504 is an axially symmetric construct whose longitudinal axis forms the axis of rotation for itself and the torque limiter assembly. Spindle 504 is comprised of threaded section 542 and base plate 540. Threaded section 542 is a cylindrical stanchion, except for two opposing flat surfaces 604 and 605. Adjacent the flat surfaces, threaded section 542 is threaded to receive gland nut 514. Adjacent threaded section 542 is base plate 540. Base plate 540 serves as one side of a cylindrical brake caliper. The surface of base plate 540 is machined flat to a tolerance of about 2 tenths of a mil to maximize the contact area with brake lining 506. Spindle 504 further includes drive shaft hole 530. Drive shaft hole 530 is a key-hole shaped hole approximately 1½ to 2 inches in diameter and is concentrically aligned with spindle 504. Notch 528 interrupts the perimeter of drive shaft hole 530. Notch 528 is a keyway that cooperates with a keyway in the drive shaft of transmission 204 and a cotter key (not shown) to ensure that the drive shaft does not slip while rotating spindle 504 of torque limiter assembly 206.

Hub 502 is connected to brake disk 508 by a plurality of brake disk mounting bolts 520. Lock washers inhibit the bolts from backing out during use. Brake disk 508 is a flat disk subject to the caliper action of the torque limiter assembly 206. In the preferred embodiment, brake disk 508 is machined flat to a 2 tenths tolerance. Bushing 526 located between brake disc 508 and spindle 504 serves as a bearing between the two surfaces. The bushing of the preferred embodiment is a self lubricating brass composite impregnated with a lubricant as is known in the art. Brake disk 508 includes a concentric circular hole 606 that circumscribes spindle 504. All of the components of torque limiter assembly 206 are constructed of steel or aluminum.

Rotor plate 512 is a circular disc that forms another side of a caliper on torque limiter assembly 206. Rotor plate 512 includes rotor plate hole 608, including two opposing flat sides 610 and 611. Rotor plate 512 fits concentrically around spindle 504 and is axially movable. The opposing flat sides 610 and 611 conform to the flat surfaces 604 and 605 of spindle 504 and prevent rotation of the rotor plate with respect to the spindle.

Rotor plate 512 includes on its surface a plurality of spring seats 515. Spring seats 515 are ⅛ inch deep circular indentions in the rotor plate. Spring seats 515 house spring washers 516. Spring washers 516 are hemispherical shaped springs that, in use, maintain assembly tension and compensate for expansion or contraction of materials due to heat. In the preferred embodiment, spring washers 516 provide contact points for pressure bolts 518 on rotor plate 512 and distribute the axial force of each bolt over the surface of the rotor plate. Pressure bolts 518 cooperate with gland nut 514 to provide equally distributed and adjustable pressure on rotor plate 512. In the preferred embodiment, there are eight (8) ¾ inch×1½ inch pressure bolts 518, machine threaded. The eight pressure bolts are spaced in a regular circular pattern equidistant from each other and the edges of the gland nut flange. In the preferred embodiment, pressure bolts 518 are fine threaded and self-locking, eliminating the need for jam nuts.

Gland nut 514 includes gland nut flange 614 and gland nut collar 616. Gland nut collar 616 includes hole 620. Hole 620 is threaded to cooperate with the threads on threaded section 542 of spindle 504. Gland nut flange 614 also includes eight threaded holes 618 for receipt of pressure bolts 518. In the preferred embodiment, gland nut collar 616 is approximately 1 inch thick and gland nut flange 614 is approximately ½ inch thick.

In between brake disk 508 and base plate 540 is brake lining 506. In between brake disk 508 and rotor plate 512 is brake lining 510. In the preferred embodiment, both brake linings 506 and 510 are made of a composite fiberglass carbon fibers and asbestos fibers as is known in the art. Brake linings 506 and 510 may be bonded to brake disk 508 with a high temperature adhesive. In an alternate embodiment, the frictional surfaces of brake linings 506 and 510 are integrally formed with brake disk 508. In another alternative embodiment, the brake linings are not connected to the brake disk and are free to rotate.

In use, housing 104 is mounted to surface 112 with a plurality of anchors 114. Barrier arm 102 is attached to arm frame 106 which is pivotally mounted to housing 104 on shaft 212. Door 306 is opened or removed to expose torque limiter assembly 206 and allow access to pressure bolts 518. The torque on each pressure bolt is then adjusted to increase or decrease the friction force provided by the torque limiter assembly. The friction force of torque limiter assembly 206 is adjusted to be sufficient to ensure that the torque on the drive shaft from transmission 204 will rotate auxiliary crank 220 and thus shaft 212 and the connected barrier arm 102 without damaging the transmission in the preferred embodiment. The weight and resultant moment arm of barrier arm 102 is generally balanced by counterweight 108, therefore the required friction force of the torque limiter assembly is relatively low and can range from 1,000 to 20,000 in-lbs depending on the specific application. A range of 0.6 to 12 ft-lbs of torque on each of the eight pressure bolts will result in the desired range of friction force. Table 1 approximates the ft-lbs of torque required on each pressure bolt to achieve the desired friction force of the torque limiter assembly.

TABLE 1

| | Bolt Torque on each Pressure Bolt (ft-lbs) | | | | | |
|---|---|---|---|---|---|---|
| | .6 | 1.2 | 3 | 6 | 9 | 12 |
| Friction Force of Torque Limiter Assembly (in-lbs) | 1,000 | 2,000 | 5,000 | 10,000 | 15,000 | 20,000 |

Optimally, the desired friction force is sufficient to rotate the torque limiter assembly, the connecting parts, and the barrier arm. In the event that an outside force such as high winds, a vehicle forcing its way under the barrier arm, or a person lifting the barrier arm, the friction will be overcome and only barrier arm 102, shaft 212, auxiliary crank 220, and hub 502 connected to brake disk 508 will rotate. Torque limiter assembly 206 allows brake disk 508 to rotate while spindle 504 and the drive shaft extending from transmission 204 remain stationary thus protecting the internal gears and linkages of transmission 204 and motor 202.

Figure 7:
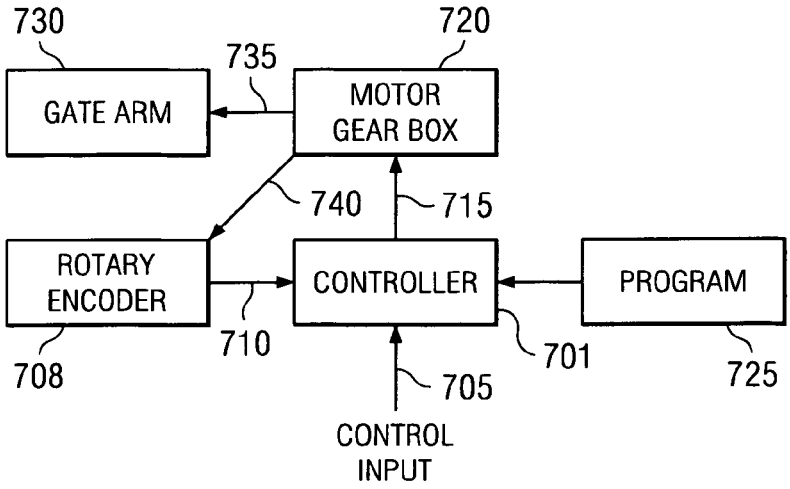
FIG. 7 is a schematic diagram showing the components of one preferred embodiment.

Referring now to FIGS. 2, 3 and 7, operation of the system will be described. During operation, a control signal 705, such as an electrical signal from a button or other control input device provides a "request" to move the barrier arm into a "raised" or "lowered" position to controller 701. In the preferred embodiment, controller 701 is a microprocessor or personal computer having a Pentium class processor. Controller 701 receives the request and determines the current position of barrier arm 102 via sprocket 226 and rotary encoder 708 through a signal 710 from the rotary encoder. The controller uses the signal to generate an instruction signal 715 to send to the motor gearbox assembly 720. The calculation is done by a program 725 which will be further described later. Instruction signal 715 causes the motor of the motor gearbox assembly to run until a signal is received from the rotary encoder that the relative position of gate arm 730 is correct. The position of the rotary encoder is related to the position of gate arm 730 because of a fixed mechanical linkage 735 between the gate arm and the motor gearbox assembly and the fixed mechanical linkage 740 between rotary encoder 708 and motor gearbox assembly 720. If the barrier arm has been moved to a position other than 0 degrees ("lowered") and 90 degrees ("raised") by a force other than the motor gearbox assembly, the result is that hub 502, brake disk 508, auxiliary crank 220, transmission sprocket 224, sprocket 226, and shaft 240 will have moved, thus moving the rotary encoder. But spindle 504 and thus the drive shaft extending from transmission 204 will not have moved. Corrective action is taken by the controller to move the barrier arm into either its raised or lowered position after a predetermined time period.

In operation, motor 202 and transmission 204 rotate drive shaft that extends into torque limiter assembly 206. The drive shaft rotates spindle 504. The friction force exerted by rotor plate 512 and base plate 540 on brake disk 508 causes brake disk 508 to rotate with the drive shaft. Hub 502, connected to brake disk 508, rotates simultaneously. The rotation of the drive shaft rotates the torque limiter assembly. As the torque limiter assembly rotates, auxiliary crank 220 rotates. As auxiliary crank 220 rotates, roller chain 314 rotates transmission sprocket 224. As transmission sprocket 224 rotates, shaft 240 rotates and rotary encoder 208 tracks its position. Auxiliary crank 220, connecting rod 308, and crank 216 acting together rotate shaft 212. As shaft 212 rotates, barrier arm 102 rotates into position.

Figure 8:
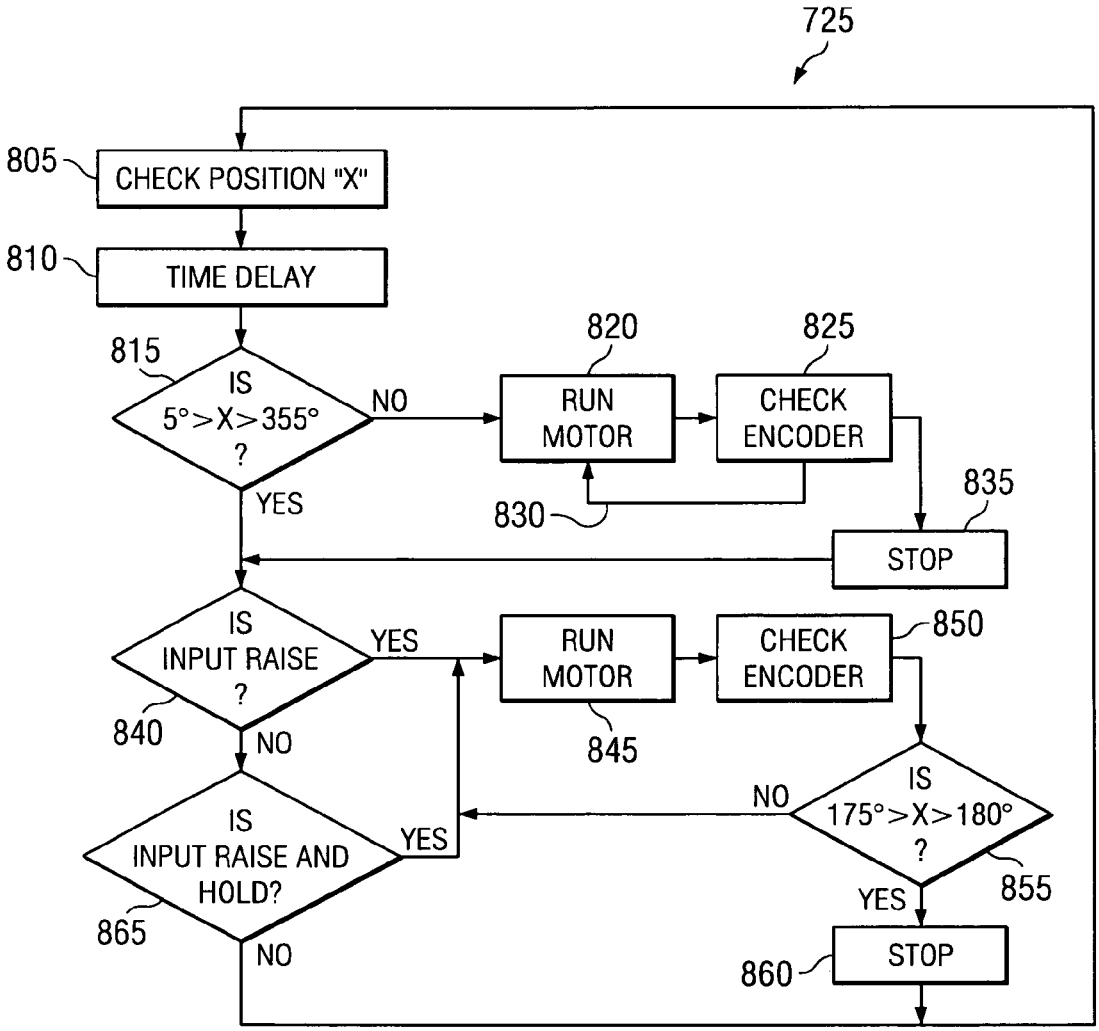
FIG. 8 a flow chart of a program run by a controller of one preferred embodiment.

FIG. 8 is a flow chart of program 725, showing greater detail. At step 805, the controller checks the position of the rotary encoder to determine the angular position of the sprocket. The angular position can be anywhere between 0 degrees and 359 degrees. At about 0 degrees (top dead center) the arm is in a lowered position. Between about 0 degrees and 180 degrees the arm is in transition from a lowered position to a raised position. At about 180 degrees (bottom dead center), the arm is in a raised position. At about 180 degrees to about 360 degrees the arm is in transition between being raised and being lowered. At step 810, if the control input is "raise" or if there is no control input, the controller waits a predetermined period of time, in the preferred embodiment approximately 30 seconds. If the control input is "raise and hold", the time delay is about five minutes. The controller then checks the sprocket to determine if it is between about 5 degrees and 355 degrees at step 815. If not, the controller sends a signal to run the motor at 820 and check the rotary encoder at step 825 until the condition is met at loop 830. Once met the controller issues a stop signal at step 835 and continues with step 840. If the condition is met at step 815, the controller continues at step 840 as well. At step 840, the controller checks to see if an input has been delivered with a "raised" instruction. If a "raise" input has been delivered the controller moves to step 845 where it runs the motor and check the encoder at step 850 to determine if the condition is met at step 855. At step 855, the controller decides if the position of the encoder is between 175 degrees and 180 degrees. If it is, then at step 860 it stops the motor. If not, it returns to step 845 until the condition is met. If at step 840 the input is not a "raise" condition then the controller advances to step 865 to check if the control input is "raise and hold". If it is, then the controller advances to step 845. If not, the controller returns to step 805. If the controller at step 860 determines the condition is met the motor is stopped and the controller returns to step 805.

Figure 9A:
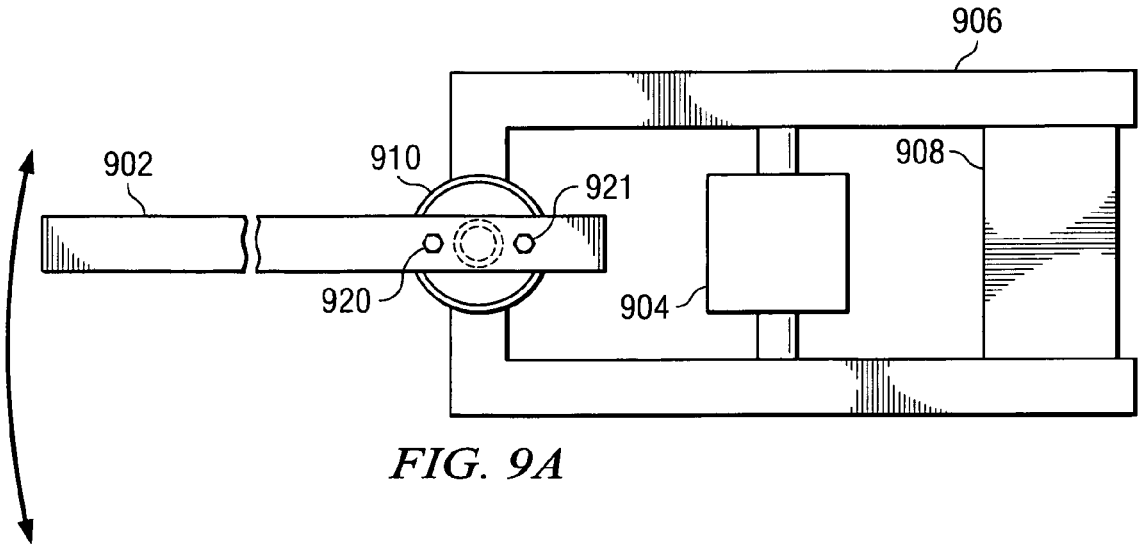
FIG. 9*a* is a plan view of an alternate embodiment of the present invention having a second torque limiter assembly.
Figure 9B:
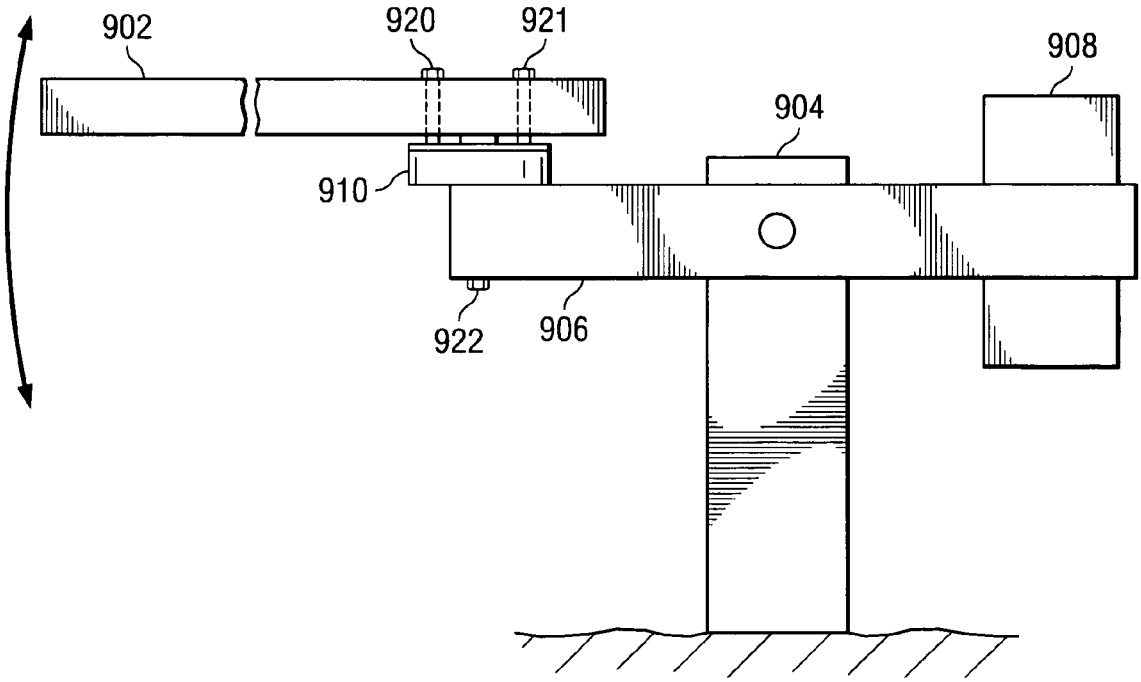
FIG. 9*b* is an elevation view of an alternate embodiment of the present invention having a second torque limiter assembly.

FIGS. 9*a* and 9*b* show an alternate embodiment of the present invention. Arm frame 906 is pivotally mounted to housing 904. Counterweight 908 is affixed to one end of arm frame 906. Torque limiter assembly 910 is mounted to the opposite end of arm frame 906. Barrier arm 902 is mounted to torque limiter assembly 910. The hub of torque limiter assembly 910 is rigidly connected to arm frame 906 by a set of mounting bolts 922. Barrier arm 902 is rigidly connected to the gland nut of torque limiter assembly 910 by mounting bolts 920 and 921. In the alternate embodiment shown, mounting bolts 920 and 921 occupy two axially opposed threaded holes of the gland nut previously used by pressure bolts. In operation, when a vehicle abuts barrier arm 902, torque limiter assembly 910 allows the barrier arm to pivot horizontally about its vertical axis without breaking. The hub of torque limiter assembly 910 remains stationary as it is fixed to arm frame 906 and the barrier arm pivots with the spindle section of torque limiter assembly 910 against the braking force created by torque limiter assembly 910. Torque limiter assembly 910 holds the barrier arm in the compromised position as the vehicle passes through thus reducing further damage to the vehicle.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A barrier gate comprising:

a support frame;

a first shaft rotatably supported by the support frame;

a barrier arm, connected to the first shaft by a connection means;

a first crank arm affixed to the first shaft;

a rod pivotally connected to the first crank arm;

a crank plate rotatably connected to the rod and rigidly affixed to a first sprocket;

a chain means, engaged with the first sprocket and a second sprocket, for maintaining the first sprocket and the second sprocket at 1:1 correspondence;

a rotary encoder, operationally connected to the second sprocket, for sensing a continuous angular displacement of the barrier arm;

a horizontal axis torque limiter assembly rotatably connected to the rod;

a transmission pivotally connected to the horizontal axis torque limiter assembly; and a motor operationally connected to the transmission wherein the horizontal axis torque limiter assembly further comprises, a hub assembly, including a circular disk having an offset hole and a raised perimeter wall;

a spindle assembly, including a concentrically aligned base flange and a threaded stanchion;

a first brake lining adjacent the base flange and concentrically aligned with the spindle assembly;

a circular brake disk including a concentrically aligned brake disk hole rigidly affixed to the raised perimeter wall adjacent a second brake lining;

a caliper disk assembly, adjacent the second brake lining, including a gland nut axially adjustable with respect to the threaded stanchion, the gland nut having a support flange adjacent an axially adjustable rotor plate;

a plurality of spring seats spaced radially equidistant around the axially adjustable rotor plate;

a plurality of spring washers, adjacent the rotor plate, in the plurality of spring seats;

a plurality of threaded holes, in the support flange, formed in a radially equidistant pattern;

a plurality of bolts, positioned in the plurality of threaded holes in the support flange, contacting the plurality of spring washers; and, wherein the plurality of bolts cooperates with the gland nut, the plurality of spring washers, and the plurality of spring seats to provide equally distributed and adjustable pressure on the rotor plate.

2. The barrier gate of claim 1 wherein the first brake lining and the second brake lining are fused to the circular brake disk.

3. The barrier gate of claim 1 further comprising a controller, in communication with the rotary encoder and the motor, programmed to:

a) receive an input signal of the group of input signals "raise" and "raise and hold";

b) if the input signal is "raise" then sending a first run signal to the motor until the rotary encoder reaches a first position between 175 degrees and 185 degrees and then waiting a first predetermined time period before sending a second run signal to the motor until the rotary encoder reaches a second position between 5 degrees and 355 degrees;

c) if the input signal is "raise and hold", then sending the first run signal and then waiting a second predetermined time period before sending the second run signal; and d) polling the rotary encoder for a position error signal until the input signal is received.

4. The barrier gate of claim 3 wherein the position error signal is a signal from the rotary encoder of the group of positions: a third position between about 5 degrees and 175 degrees and a fourth position between about 185 degrees and about 355 degrees.

5. A method of reconfigurably controlling position of a barrier arm relative to a support surface comprising:

providing a first shaft rotatably supported by the support frame;

providing a barrier arm, connected to the first shaft by a connection means;

providing a first crank arm affixed to the first shaft;

providing a rod pivotally connected to the first crank arm;

providing a crank plate rotatably connected to the rod and rigidly affixed to a first sprocket;

providing a chain means, engaged with the first sprocket and a second sprocket, for maintaining the first sprocket and the second sprocket at 1:1 correspondence;

providing a hub assembly, including a circular disk having a raised perimeter wall and an offset hole, rotatably connected to the rod;

providing a spindle assembly, including a concentrically aligned base flange and a threaded stanchion;

providing a first brake lining adjacent the base flange and concentrically aligned with the spindle assembly;

providing a circular brake disk including a concentrically aligned brake disk hole rigidly affixed to the raised perimeter wall adjacent a second brake lining;

providing a caliper disk assembly, adjacent the second brake lining, including a gland nut axially adjustable with respect to the threaded stanchion, the gland nut having a support flange adjacent an axially adjustable rotor plate;

providing a plurality of spring seats spaced radially equidistant around the axially adjustable rotor plate;

providing a plurality of spring washers, adjacent the rotor plate, in the plurality of spring seats;

providing a plurality of threaded holes, in the support flange, formed in a radially equidistant pattern;

providing a plurality of bolts, positioned in the plurality of threaded holes in the support flange, contacting the plurality of spring washers;

providing a transmission rigidly connected to the spindle assembly; providing a motor operationally connected to the transmission;

providing a sensor attached to the second sprocket for reporting a signal related to a position of the barrier arm; and reconfiguring the position of the barrier arm upon a first signal from the sensor.

6. The method of claim 5 wherein the position is generally parallel to the support surface.

7. The method of claim 5 wherein the position is generally perpendicular to the support surface.

8. The method of claim 5 wherein the position is generally between generally parallel and generally perpendicular to the support surface.

9. The method of claim 5 further comprising the steps of:

providing a controller connected to the sensor and performing the further steps of:

monitoring the first signal;

comparing the first signal to a predetermined position of the barrier arm;

sending a second signal to the motor if the barrier arm is not in the predetermined position.

10. The method of claim 5 further comprising the step of:

providing a vertical clutch attached between the barrier arm and the first shaft; and providing a brake disc and a clutch plate in the vertical clutch to hold a horizontal position of the barrier arm static by a friction force.

11. The method of claim 10 wherein the horizontal position is generally parallel to the first shaft.

12. The method of claim 10 wherein the horizontal position is not generally parallel to the first shaft.

13. The method of claim 5 wherein the step of reconfiguring comprises the further steps of:

activating the motor; and running the motor until a predetermined position is achieved.

14. The method of claim 13 wherein the predetermined position is one of the group of "raised" and "lowered".

15. The method of claim 5 wherein the step of reconfiguring further comprises moving the barrier arm without moving the motor.

* * * * *